United States Patent [19]

Symbol

[11] 4,253,353

[45] Mar. 3, 1981

[54] IMPACT WRENCH FOR HEXAGONAL NUTS

[76] Inventor: Paul P. Symbol, 1311 Barberry La., Round Lake, Ill. 60073

[21] Appl. No.: 71,703

[22] Filed: Aug. 31, 1979

[51] Int. Cl.[3] ..... B25B 19/00

[52] U.S. Cl. ..... 81/121 R; 81/463

[58] Field of Search ..... 81/52.3, 53, 121 R, 81/57.39

[56] References Cited

U.S. PATENT DOCUMENTS

| | | | |
|---|---|---|---|
| 1,941,565 | 1/1934 | Mandl | 81/52.3 |
| 3,930,776 | 1/1976 | Keller | 81/57.39 |
| 4,079,641 | 3/1978 | Junkers | 81/57.39 |

FOREIGN PATENT DOCUMENTS

| | | | |
|---|---|---|---|
| 524681 | 11/1976 | U.S.S.R. | 81/52.3 |

OTHER PUBLICATIONS

American Machinist, vol. 43, No. 11, Sep. 9, 1915, p. 444.

*Primary Examiner*—James L. Jones, Jr.
*Attorney, Agent, or Firm*—Tilton, Fallon

[57] ABSTRACT

An impact wrench for hexagonal nuts including a unitary metal plate having a central hexagonally shaped aperture and six equally peripherally spaced notches, each having an impact surface coplanar with successive sides of the nut.

6 Claims, 3 Drawing Figures

FIG. 1
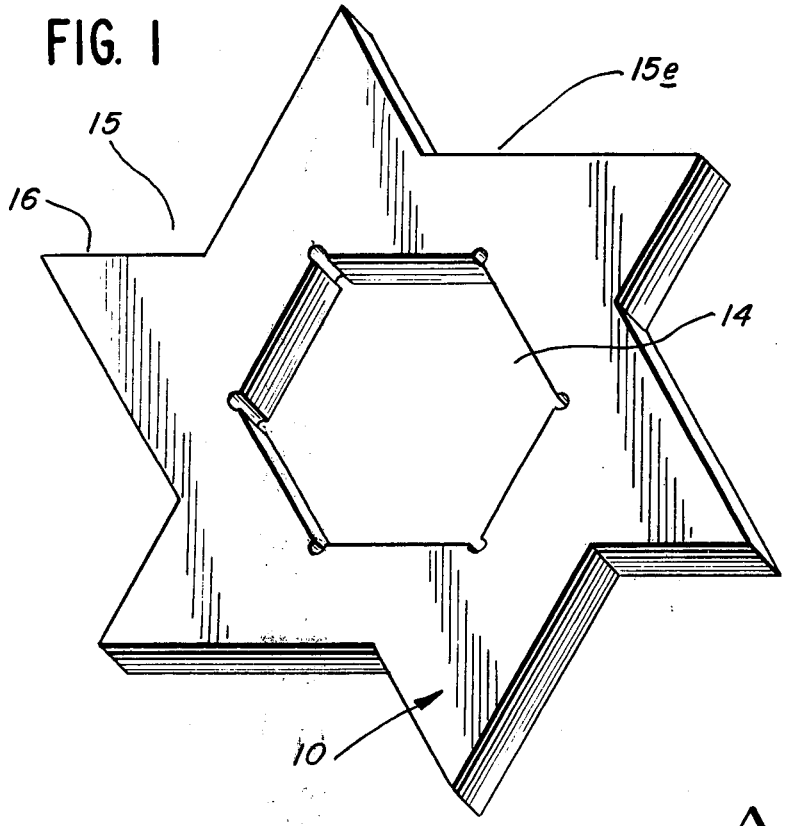
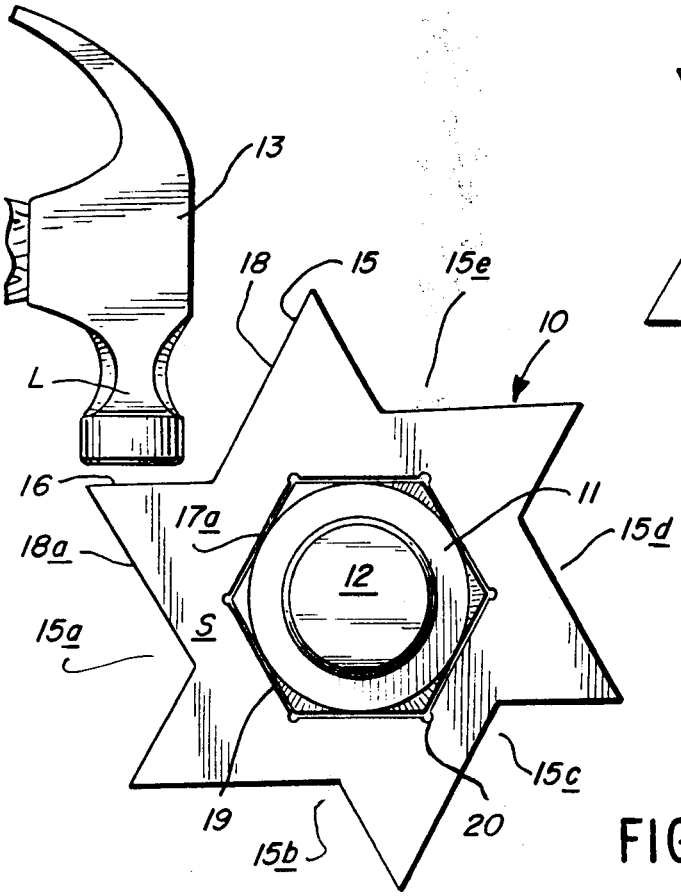
FIG. 2
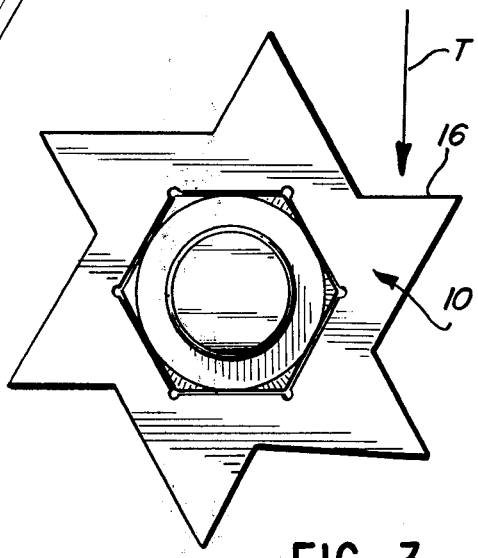
FIG. 3

IMPACT WRENCH FOR HEXAGONAL NUTS

BACKGROUND AND SUMMARY OF INVENTION

This invention relates to an impact wrench for hexagonal nuts and, more particularly, a unitary plate which is adapted to be struck by a hammer to loosen or tighten such nuts.

The idea of providing an impact wrench having a socket for the receipt of the nut so as to facilitate tightening or loosening is of real vintage—see Mandl U.S. Pat. No. 1,941,565 and the discussion therein. Such wrenches have not found favor with the trade because of the complexity of their manufacture and use and the fact that they have been unable to deliver maximum force to the "point of attack" in a simple, understandable manner.

The inventive impact wrench differs in overcoming these drawbacks and includes a metal plate member centrally apertured for a specific size hexagonal nut and with the periphery equipped with six equally spaced V-shaped notches. Each notch has one of the V-shaped defining surfaces aligned with a side of the nut to provide a hammer impact surface and with the impact surfaces being successively coplanar with the sides of the nut as one proceeds around the nut and from notch to notch. The other surface defining the V-shape is disposed parallel to an adjacent side of the nut, i.e., a side adjacent to the side with which the impact surface is coplanar. This results in a uniform section for the optimum transmission of loosening or tightening forces.

Other objects and advantages of the invention may be seen as this specification proceeds.

DETAILED DESCRIPTION

The invention is described in conjunction with an illustrative embodiment in the accompanying drawing, in which FIG. 1 is a perspective view of the inventive impact wrench;

FIG. 2 is a top plan view of the wrench as installed on a bolt-equipped nut and showing a hammer in the process of applying a loosening force; and FIG. 3 is another plan view of the invention but with the wrench inverted from the position seen in FIG. 2.

In the illustrtion given, and with reference first to FIG. 2, the numeral 10 designates generally the plate-like wrench which is advantageously constructed of hardened steel. The wrench is seen installed about a nut 11 carried by a bolt 12. A hammer 13 is positioned so as to exert a loosening force L against the wrench 10. Advantageously the plate-like wrench 10 has a thickness (see FIG. 1) approximating that of the specific sized nut for which it is intended.

The wrench 10 is equipped with a central aperture 14 which is hexagonally contoured so as to accommodate the specific nut 11. Here it will be appreciated that various wrenches will be employed for various sized nuts.

The periphery of the wrench is equipped with 15 equally peripherally spaced, identical notches 15. These notches 15 are generally V-shaped and are defined in part by a first or impact surface 16 as can be appreciated from a consideration of FIG. 1, the impact surface 16 of the notch 15 is generally coplanar with a specific side 17 of the nut 11.

In like fashion, the impact surface **16*a* of the notch 15*a* (proceeding counterclockwise in FIG. 1) is coplanar with the nut side 17*a*, and this relationship continues as one proceeds in succession around the wrench via the various notches 15*b*, 15*c*, 15*d* and 15*e***.

Each notch is defined by a second surface as at 18 relative to the notch 15. This second notch-defining surface extends parallel to a side of the nut adjacent to that side with which the first or impact defining surface is coplanar. For example, the surface 18 is parallel to the side **17*a* of the nut which results in a section of uniform thickness and width. Thus, an impact force against the surface 16 (as illustrated at L) is transmitted via a section S defined by the outer surface 18*a* and the side 19 of the aperture 11 to which the surface 18*a*** is parallel.

The aperture 11, in the six corners thereof developed by the hexagonal shape, is equipped with recesses as at 20 to provide stress relief and thereby avoid the possibility of fracture.

Further, and irrespective of the size of the nut for which the wrench is intended, I provide the impact surfaces 16, **16*a*, etc. of a size, i.e., length, to accommodate striking by the normal hammer. Thus the length of the impact surfaces 16, 16*a***, etc. is at least about 1" (25 mm.). Optimally, this length is about 1½" (37 mm.).

In one specific embodiment of the invention, the wrench is engineered for a 2½" hex nut, i.e., a nut 11 mounted on a bolt 12 having a nominal diameter of 1¾". The nut 11 in this specific illustration has sides measuring approximately 1½". The wrench 10 had a thickness of ⅜" and the length of the impact surfaces 16, **16*a*, etc. was 1½". The section S measured ¾" between the surfaces 18*a* and 19. The surfaces 18, 18*a***, etc. had a length of approximately 2⅜".

In the operation of the invention, the provision of the wrench as described permits easy and convenient tightening or loosening inasmuch as a new impact surface becomes available after only 60° of nut turning. Also because of the construction of the wrench 10, a maximum torque is applied to the nut in a direction tangential to the threads of the bolt.

Further, and generally irrespective of the size of the nut for which the wrench is intended to be used, I provide the stress relief recesses of a diameter of about 4–5 mm. (approximately 3/16"). The size of the aperture 14 is such as to provide a clearance of the order of 1 mm. between each side 19 of the aperture and the confronting side 17 of the nut 11.

It will be appreciated that the same advantageous mode of operation is employed for tightening as well as loosening—see FIG. 3 where the wrench 10 has been turned over (from the orientation of FIG. 2) and a tightening force T is applied to one of the impact surfaces 16.

I claim:

1. An impact wrench for a specific size hexagonal nut comprising a unitary metal plate having a thickness of said nut, said plate having a hexagonally shaped central aperture extending therethrough so as to ensleeve said nut, said plate being equipped with notches on the periphery thereof to provide six equally peripherally spaced impact surfaces of a size adapted to be struck by a hammer and said surfaces in succession being generally coplanar with successive sides of said nut, each notch being defined by a second surface parallel with the side of said nut adjacent to the first mentioned side.

2. The structure of claim 1 in which said aperture is equipped with a stress-relief recess at each corner of the hexagonal shape thereof.

3. The structure of claim 1 in which each of said impact surfaces has a length of at least about 1" (25 mm.).

4. The structure of claim 3 in which said length is about 1½" (37 mm.).

5. An impact wrench for a specific size hexagonal nut comprising a unitary metal plate having a central aperture contoured to said nut, the periphery of said plate being equipped with six equally spaced apart V-shaped notches, each notch being defined by two intersecting surfaces wherein a first surface of each notch extends coplanar to a side of said nut and the second surface extends parallel to a side of said nut adjacent to the first mentioned side, the first surfaces in succession being coplanar with successive sides of said nut.

6. The structure of claim 5 in which said central aperture at the corners defined by the hexagonal contour thereof is equipped with cylindrical recesses to provide stress relief against fracture.

* * * * *